United States Patent [19]

Larkin

[11] Patent Number: 4,775,184

[45] Date of Patent: Oct. 4, 1988

[54] ROCKING CHAIR

[76] Inventor: Lloyd V. Larkin, 3818 Chippewa Ave., St. Louis, Mo. 63116

[21] Appl. No.: 935,410

[22] Filed: Nov. 26, 1986

[51] Int. Cl.[4] ..... A47C 3/027

[52] U.S. Cl. ..... 297/260; 5/109; 297/261; 297/271; 297/434

[58] Field of Search ..... 297/260, 261, 271, 272, 297/434, 295; 5/109

[56] References Cited

U.S. PATENT DOCUMENTS

| | | | |
|---|---|---|---|
| 139,838 | 6/1873 | Van Dervort et al. | 297/260 X |
| 185,189 | 12/1876 | Platt | 297/434 X |
| 342,296 | 5/1886 | Grunwald | 297/259 |
| 1,244,389 | 10/1917 | Stockwell | 297/260 |
| 2,874,756 | 2/1959 | Simon | 297/434 |
| 3,669,490 | 6/1972 | Bertolet | 297/272 |
| 3,842,450 | 10/1974 | Pad | 297/260 X |
| 3,886,608 | 6/1975 | Casella | 297/260 X |

FOREIGN PATENT DOCUMENTS

| | | | |
|---|---|---|---|
| 953206 | 8/1974 | Canada | 297/260 |
| 149134 | 3/1955 | Sweden | 297/271 |

*Primary Examiner*—Kenneth J. Dorner

*Attorney, Agent, or Firm*—Senniger, Powers, Leavitt and Roedel

[57] ABSTRACT

A rocking chair having a seat and a base member, the seat including a seat member for directly supporting a person and a frame having first and second frame members, each of which frame members have a rocker portion disposed beneath the seat member and a vertical portion interconnecting the rocker portion and the seat member, the rocker portion of each frame member being curved for a substantial portion of its length and supported for rocking movement within the base member, a rear most portion of each rocker portion being angled upwardly, the frame members being constructed of a resilient material so that rocking motion of the seat causes a dampened spring motion of the seat during rocking of the chair. The chair further includes a motor to propel the chair in a rocking motion, the motor being attached to the base member so that the motor remains in a stationary position when the seat is in a rocking motion, and a mechanism connected to the motor for engaging the seat during at least a portion of its rocking motion so as to permit the seat to float free during a portion of its rocking motion.

6 Claims, 3 Drawing Sheets

ROCKING CHAIR

BACKGROUND OF THE INVENTION

The present invention relates to an improved rocking chair design and, more particularly, to a rocking chair which is motor driven and has improved rocking characteristics for added comfort and physical benefit to the user.

Prior art rocking chairs have generally been improved in the areas of comfort of seating, durability and versatility rather than in an improved rocking motion and mechanism for attaining such an improved motion as the present invention is directed to. For example, numerous improvements have been made in rocking chairs to smoothen the motion by adding padding or the like to the bottom of the rockers as is illustrated by the designs shown in U.S. Pat. Nos. 816,088, 888,224, 983,758, 1,233,006, 1,252,418, 1,435,432, 1,618,646 and 2,054,487. Likewise, improvements have been made to prevent damage by the rockers to a floor (such as is shown by U.S. Pat. No. 3,669,490) and to make a rocking chair folding (such as is shown by U.S. Pat. No. 3,026,143). Also, rockers have been motorized to automatically rock the chair and thus reduce the effort needed by the user to achieve the desired effect (see U.S. Pat. No. 1,985,131).

However, heretofore improvements have not been made in the rocking motion to inhance the effectiveness in the soothing motion attained by the user of a rocking chair. Also, in motorized versions, such as that disclosed in the above referred to U.S. Pat. No. 1,985,131, the motor is directly connected to the chair and moves with the chair and further is permanently interconnected to the base frame so that there is always a positive interconnection between the base and the chair, both of which features inhibit the natural motion of the chair.

SUMMARY OF THE INVENTION

The present invention provides an improvement in a rocking chair which inhances the rocking motion and is motorized, by providing a seat and a base member, the seat including a seat member for directly supporting a person and a frame having first and second frame members, each of which frame members have a rocker portion disposed beneath the seat member and a vertical portion interconnecting the rocker portion and the seat member, the rocker portion of each frame member being curved for a substantial portion of it's length and supported for rocking movement within the base member, a rear most portion of each rocker portion being angled upwardly, the frame members being constructed of a resilient material whereby rocking motion of the seat causes a dampened spring motion of the seat during rocking of the chair. The chair further includes an alignment means adapted to maintain the chair in a stationary position. The chair also includes a motor to propel the chair in a rocking motion, the motor being attached to the base member whereby the motor remains in a stationary position when the seat is in a rocking motion and means connected to the motor for engaging the seat during at least a portion of its rocking motion so as to permit the seat to float free during a portion of its rocking motion.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
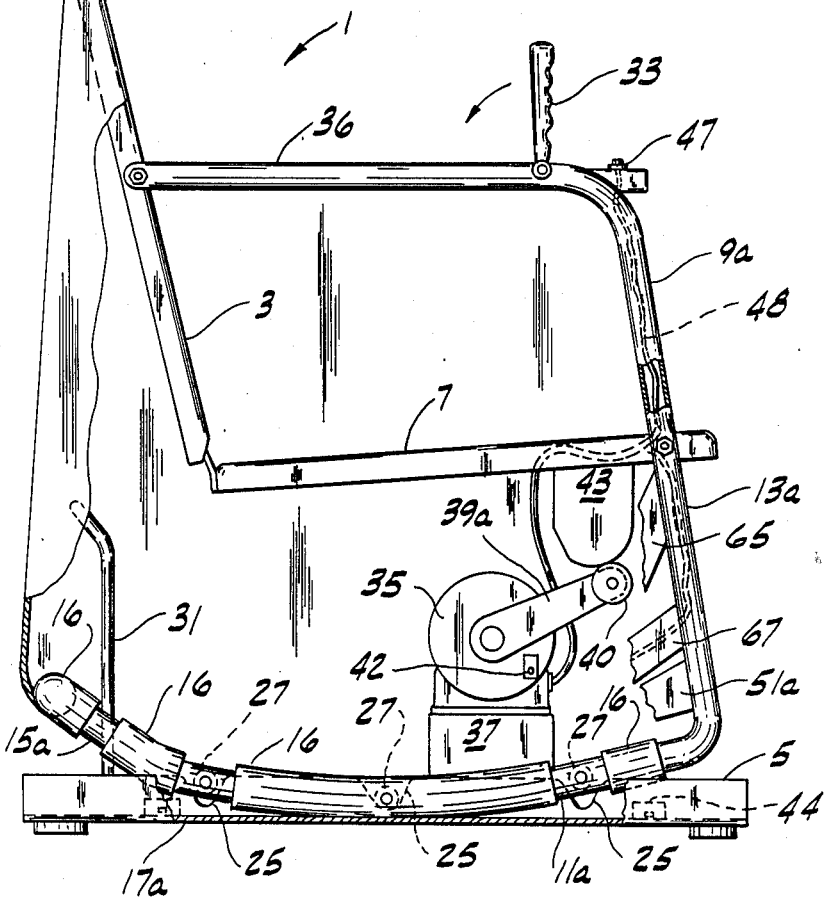
FIG. 1 is a side view of a preferred embodiment of the present invention with portions partially cutaway to reveal internal details.
Figure 2:
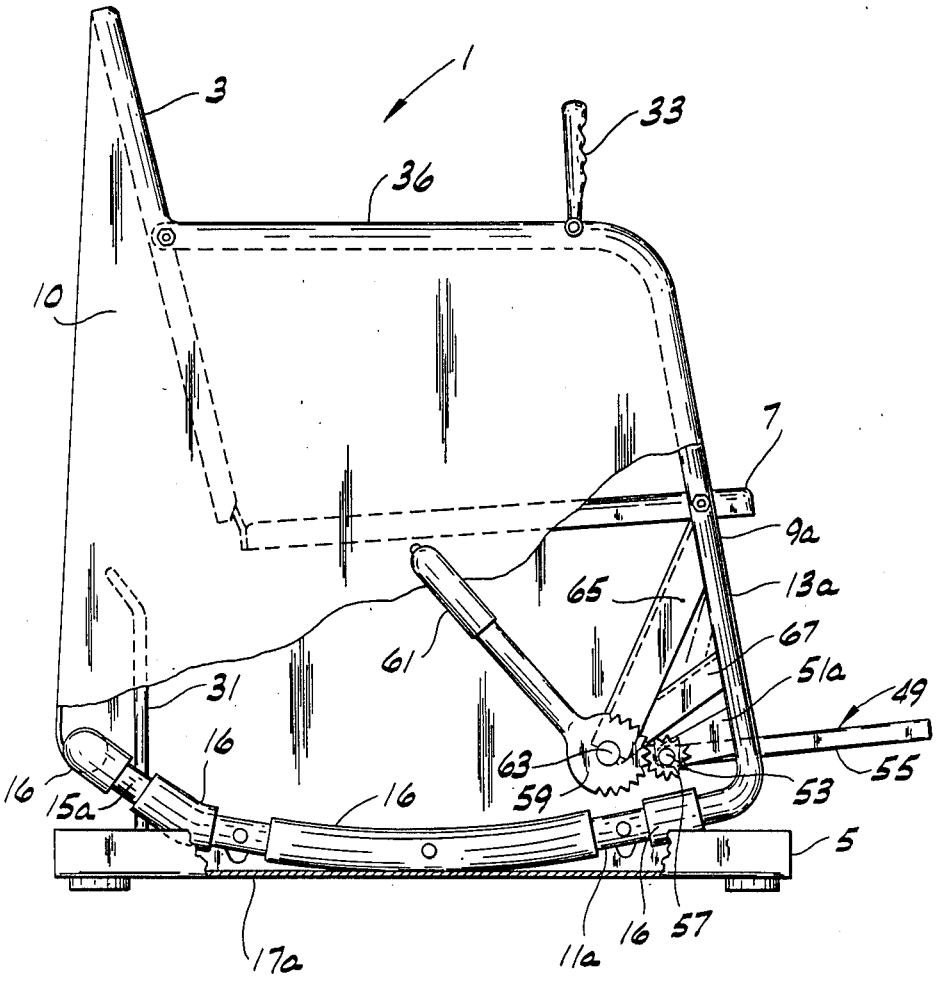
FIG. 2 is a side view similar to FIG. 1, but with other portions partially cutaway to reveal other details.

The preferred embodiment of the chair of the present invention is designated in its entirety by the reference numeral 1. As best shown in FIGS. 1 and 2, the rocking chair includes a seat 3 and a stationary base member 5. The seat 3 includes a seat member 7, for directly supporting a person, and a frame 9 having first and second frame members, **9*a* and 9*b*. The frame 9 can be surrounded by a fabric cover 10, if desired. Each of the frame members 9*a* and 9*b* are shaped to form a rocker portion 11*a* and 11*b*, respectively, which are disposed beneath the seat member 7, and vertical portions 13*a* and 13*b*, respectively, interconnecting the rocker portions 11*a* and 11*b* with the seat member 7**.

Rocker portions **11*a* and 11*b* each are curved for a substantial portion of their length and supported for rocking movement within base member 5. Rear most portions 15*a* and 15*b* (not shown but identical to 15*a*) of rocker portions 11*a* and 11*b*, respectively, are angled upwardly more sharply than the forward portions to cause a firm impact to be felt by a person rocking in the chair as the rocker portions transition from the curved portions 11*a* and 11*b* to the straight or upwardly angled portions 15*a* and 15*b***.

Frame members **9*a* and 9*b* are preferably constructed of a resilient material, such as steel tubing whereby the rocking motion of the seat causes a dampened spring motion of the seat during rocking of the chair. Rocker portions 11*a* and 11*b* are enclosed for a substantial portion of their length within a soft resilient material 16**, such as foam rubber tubing, which will provide a cushioning effect and thereby enhance the spring motion of the seat when the chair is rocked.

Base member 5 includes alignment means adapted to maintain the chair in proper position. The alignment means comprises first and second generally U-shaped troughs, **17*a* and 17*b*. Each of the troughs 17*a* and 17*b* includes a bottom 19*a* and 19*b* (FIG. 3), respectively, an inner wall 21*a* and 21*b*, respectively, and an outer wall 23*a* and 23*b*, respectively. As shown in FIGS. 1 and 2, troughs 17*a* and 17*b* are each of sufficient size to accomodate rocker portions 11*a* and 11*b* therein. Inner walls 21*a* and 21*b* each have multiple generally V-shaped notches 25 therein, as best illustrated in FIG. 1. Each notch 25** extends downward from the top of its respective inner wall.

Notches 25 are adapted to accomodate therein alignment devices 27. The present invention illustrates the use of three such devices. It should be apparent that the number of alignment devices could be varied without departing from the scope of this invention. Each alignment device 27 includes a steel rod 29 which runs perpendicular to and between troughs 23*a* and 23*b* and is connected to rocker portions 11*a* and 11*b* at opposite ends of the rod. Each end of each rod 27 is attached to its respective rocker portion such that the rod is positioned within one of the notches 25. Near each end of each rod 29 a roller 30 is attached to the rod. The rollers 30 are adapted to fit within the notches 25 and to be guided along the sides of these notches during rocking movement of the chair. The alignment means will maintain the chair in proper alignment with the base 5 as a person rocks in the chair. There is no other physical connection between the chair and the base 5 which might inhibit the natural motion of the chair.

The chair further includes a rear brace 31 in the form of a countoured rod which extends up from a cross plate 32 fastened at its ends to the troughs 17*a* and 17*b*. The brace 31 has a central section 34 adapted to inhibit the rearward motion of the chair beyond a predetermined point in the rearward rocking motion of the seat 3.

A handle 33 is attached to each armrest 36 of the rocking chair for assisting in manual rocking of the chair, if desired, and for providing a stabilizing grip when the chair is rocked automatically. The handles 33 are attached to each armrest 36 so that each handle can be pivoted vertically with respect to its armrest. Each of the handles 33 can be rotated and locked into a vertical position so that the longitudinal axis of each handle is generally 90° to the respective armrest. The handles are equipped with a mechanism, such as a detent on the arm rest (not shown) to disengage and allow each handle to be retracted to a position whereby the handle lies parallel to its respective armrest when the handle is not in use.

Figure 3:
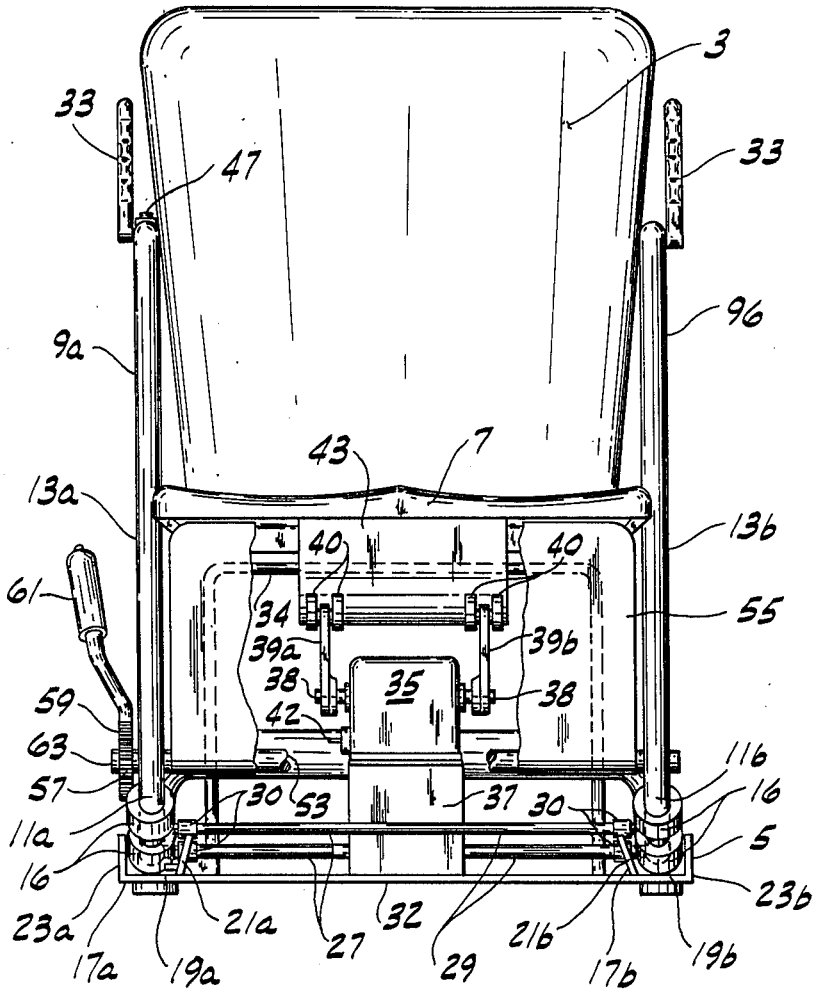
FIG. 3 is a front view of the embodiment of FIG. 1 with the footrest partially cutaway to show internal details of the chair.

As shown in FIGS. 1 and 3, the chair further includes a motor 35 to propel the chair in a rocking motion. The motor is attached to base member 5 by means of motor mount assembly 37. Motor mount assembly 37 is attached to cross plate 32 and extends upward from the base member a sufficient distance to support the motor 35 for proper movement of rocker portions 11*a* and 11*b*. The motor mount assembly is free of connection to frame members 9*a* and 9*b*, thereby remaining in a stationary position on base member 5 when the seat 3 is rocked.

The motor includes a pair of arms 39*a* and 39*b* which are mounted at one end of each to the drive shaft 38 of the motor 35 for rotation therewith. The arms 39*a* and 39*b* each have mounted for rotation at their free end a pair of rollers 40. The motor rotates the arms 39*a* and 39*b* counterclockwise, as shown in FIG. 1, so that the rollers 40 engage a baffle 43 mounted to the underside of the seat 3 and roll along its surface. The baffle 43 can be formed of sheet metal and has a curved front portion, as viewed in FIG. 1, and a flat rear portion. As the motor rotates the arms 39*a* and 39*b* the rollers 40 will first engage the front curved portion of the baffle 43 and roll along it to cause the seat 3 to be rocked rearwardly. As the rotation of the arms continues, the rollers 40 will continue to roll over the curved front portion of the baffle and rotate the seat 3 further rearwardly until the rollers reach the flat rear portion of the baffle.

Once the rollers 40 reach this flat portion they will disengage from the baffle 43 and the motor will continue its counterclockwise rotation so that the rollers 40 will again approach the baffle on the next rotation (or subsequent rotation depending on the timming of rotation and the natural rocking cycle of the seat 3). As the rollers 40 leave the baffle 43 the seat will slow its rearward movement, since it is no longer being driven rearward by the motor, and it will eventually begin its free floating movement forward where it will subsequently be re-engaged by the rollers. To prevent possible interference motion between the rollers 40 and baffle 43, during rocking of the chair such as might be caused by non-synchronous motion of the rocking chair 3 and rotating motor 35, a motion sensing and motor control circuit is provided. The circuit includes a first trip switch 42 mounted to the side of motor 35 so as to be contacted by arm 39*a* each time it passes the switch during its rotation. The circuit also includes a second trip switch 44 mounted in trough 17*a* at a location where it will be contacted by the front portion of rocker portion 11*a* as it rocks to its forward most position. The two switches 42 and 44 are connected to the motor 35 so that the motor will be stopped if the rollers 40 and baffle 43 are not in proper relation when the arm 39*a* engages switch 42. For example, if at the time of engagement of arm 39*a* with switch 42 the front portion of rocker portion 11*a* has not engaged and activated switch 44 the motor 35 will be stopped until switch 44 is activated and then the motor will resume its rotation.

Provision can be made (although not shown) for adjusting the length of the arms 39*a* and 39*b* or otherwise adjusting the period of engagement between the rollers 40 and baffle 43 to cause the seat 3 to be rocked further back or reduce the rocking movement of the seat, as desired. The motion can also be adjusted to permit a normal rocking motion of the chair as though it were manually rocked. It is preferable, however, that the seat be rocked sufficiently rearward that the rocker portions 11*a* and 11*b* pass in their engagement with the troughs 17*a* and 17*b*, the transition point between the curved portion and the straight or upwardly angled portion to attain the benefits of the resultant motion, although this is not essential. Arms 39*a* and 39*b*, rollers 40 and baffle 43 constitute means connected to the motor for engaging the seat 3 during at least a portion of its rocking motion so as to permit the seat to float free during a portion of its rocking motion.

A rheostat switch 47 is provided which is electrically connected such as by wire 48 to the motor 35 and attached to one of the armrests 36 of the chair 1 for providing the person sitting on the chair control over the motor function by allowing that person to turn on the motor and adjust its speed within predetermined limits.

Figure 4:
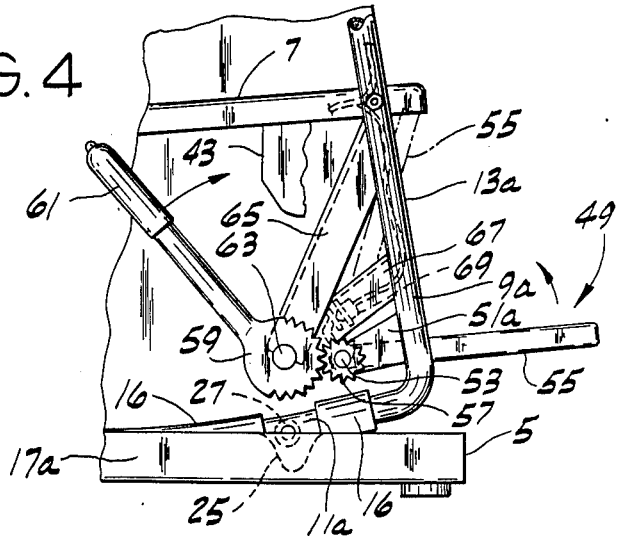
FIG. 4 is a partial side view of the preferred embodiment showing the footrest operating mechanism in more detail.

A retractable footrest 49 as shown in FIG. 2 and 4 is secured to the lower portion of the seat 3. Braces 51*a* and 51*b* on opposite sides of the seat (only the right side brace 51*a* being shown in FIG. 2) are secured to their respective vertical portions 13*a* and 13*b* of the frame 9 and support at their ends a shaft 53 on which is mounted a foot support plate 55 for pivotal movement with the shaft 53 between the solid line position and the phantom line position shown in FIG. 4. At one end of shaft 53 is fixed a gear 57 for rotation therewith. A drive gear segment 59 is formed in part of a rotatable handle 61 and is positioned in meshing engagement with gear 57. The handle 61 is mounted to a rotatable shaft 63 which in turn, is mounted for rotation at the ends of support plates 65 and 67 which are secured to the vertical portion 13*a* of frame 9.

The handle 61 can thus be pivoted to cause the foot support plate to be moved between its stored position under seat 3 and its usable position extending outwardly from beneath the seat. If desired, an interlock switch 69 can be provided to prevent operation of the motor 35 unless the foot support plate is rotated to the usable position.

As various changes could be made in the above constructions without departing from the scope of the invention, it is intended that all matter contained in the above description or shown in the accompanying drawings shall be interpreted as illustrative and not in a limiting sense.

What is claimed is:

1. A rocking chair, comprising: a seat and a base member, said seat including a seat member for directly supporting a person and a frame having first and second frame members, each of said frame members having a rocker portion disposed beneath said seat member and a single vertical portion interconnecting the rocker portion and said seat member at the front thereof so that said seat member is cantilevered from the vertical portions of the frame members, said rocker portion of each frame member being curved for a substantial portion of its length and supported for rocking movement within the base member, a rear most portion of said rocker portion being angled upwardly, said frame members being constructed of a resilient material whereby rocking motion of said seat causes a dampened spring motion of the seat member during rocking of the chair, said chair further including alignment means, said alignment means adapted to maintain the chair in a stationary position, said chair further including a motor to propel said chair in a rocking motion, said motor being attached to said base member whereby said motor remains in a stationary position when the seat is in a rocking motion, means connected to said motor for temporarily engaging said seat member during a portion of the seat's rocking motion so as to permit the seat to float free during a further portion of its rocking motion, said means including a baffle mounted to said seat for movement therewith, a pair of arms mounted to the motor for rotation and a roller supported by the arms for rotation therewith so as to engage said baffle during a portion of the rotational movement of said arms and said roller so as to cause rearward movement of the seat.

2. A rocking chair as set forth in claim 1 wherein said baffle has a curved forward portion which is engaged by the roller when the seat is propelled rearwardly thereby, and a flat rear portion adjacent to the curved portion and so positioned that the roller disengages the baffle when the roller reaches the flat portion.

3. A rocking chair as set forth in claim 1 wherein a rheostat switch is electrically connected to said motor, said switch adapted to control the operation of said motor, said switch being attached to one of said armrests whereby a person sitting in said chair can easily access said switch to control the motor.

4. A rocking chair as set forth in claim 1 wherein said rocker portions are enclosed for substantially their entire length within a soft resilient material such as foam rubber, said material providing a cushioning effect when the chair is in motion.

5. A rocking chair, comprising: a seat and a base member, said seat including a seat member for directly supporting a person and a frame having first and second frame members, each of said frame members having a rocker portion disposed beneath said seat member and a single vertical portion interconnecting the rocker portion and said seat member at the front thereof so that said seat member is cantilevered from the vertical portions of the frame members, said rocker portion of each frame member being curved for a substantial portion of its length and supported for rocking movement within the base member, a rear most portion of said rocker portion being angled upwardly, said frame members being constructed of a resilient material whereby rocking motion of said seat causes a dampened spring motion of the seat member during rocking of the chair, said chair further including alignment means, said alignment means adapted to maintain the chair in a stationary position, said alignment means comprising first and second troughs, each of said troughs comprising a bottom, an inner wall and an outer wall, said first and second troughs being of sufficient size to accommodate therein said rocker portions of said first and second frame members respectively, said inner wall of each trough having multiple generally V-shaped notches adapted to accommodate alignment devices, each of said alignment devices includes a rod, said rod being connected at one end to the rocker portion of said first frame member and another end of said rod being connected to the rocker portion of said second frame member, said rod running perpendicular with respect to first and second rocker portions, said rod of each alignment device being positioned on said rocker portion whereby said rod will fall into one of said notches when the chair is in motion, each end of each rod having a wheel attached thereto, said wheels adapted to maintain said alignment devices within said notches, said alignment means maintaining said chair in proper alignment; said chair further including a motor to propel said chair in a rocking motion, said motor being attached to said base member whereby said motor remains in a stationary position when the seat is in a rocking motion, means connected to said motor for temporarily engaging said seat member during a portion of the seat's rocking motion so as to permit the seat to float free during a further portion of its rocking motion.

6. A rocking chair, comprising: a seat and a base member, said seat including a seat member for directly supporting a person, said seat having armrests and handles attached to each of said armrests, said handles being generally positioned at the front portion of said armrests, said handles being capable of readily locking into a vertical position and retracting to a horizontal position at the desire of a person using said chair, said seat further comprising a frame having first and second frame members, each of said frame members having a rocker portion disposed beneath said seat member and a single vertical portion interconnecting the rocker portion and said seat member at the front thereof so that said seat member is cantilevered from the vertical portions of the frame members, said rocker portion of each frame member being curved for a substantial portion of its length and supported for rocking movement within the base member, a rear most portion of said rocker portion being angled upwardly, said frame members being constructed of a resilient material whereby rocking motion of said seat causes a dampened spring motion of the seat member during rocking of the chair, said chair further including alignment means, said alignment means adapted to maintain the chair in a stationary position, said chair further including a motor to propel said chair in a rocking motion, said motor being attached to said base member whereby said motor remains in a stationary position when the seat is in a rocking motion, means connected to said motor for temporarily engaging said seat member during a portion of the seat's rocking motion so as to permit the seat to float free during a further portion of its rocking motion.

* * * * *